US009839808B1

(12) United States Patent
McNeil

(10) Patent No.: US 9,839,808 B1
(45) Date of Patent: Dec. 12, 2017

(54) RESPIRATORY TRAINING DEVICE AND METHOD OF USE THEREOF

(71) Applicant: Delbert E. McNeil, Perora, AZ (US)

(72) Inventor: Delbert E. McNeil, Perora, AZ (US)

( * ) Notice: Subject to any disclaimer, the term of this patent is extended or adjusted under 35 U.S.C. 154(b) by 96 days.

(21) Appl. No.: 14/814,987

(22) Filed: Jul. 31, 2015

Related U.S. Application Data

(60) Provisional application No. 62/032,868, filed on Aug. 4, 2014.

(51) Int. Cl.
*A63B 22/06* (2006.01)
*A63B 23/18* (2006.01)

(52) U.S. Cl.
CPC ..... *A63B 23/18* (2013.01); *A63B 22/06* (2013.01)

(58) Field of Classification Search
CPC . A63B 21/225; A63B 22/0605; A63B 22/001; A63B 22/0664; A63B 2208/0233; A63B 2022/067; A63B 69/16; A63B 2202/0652; A63B 2220/34; A63B 2022/0635; A63B 2022/0641; A63B 22/06; A63B 22/08; A63B 22/10; A63B 23/18
USPC ..... 482/67, 72, 52, 51, 13, 57–65
See application file for complete search history.

(56) References Cited

U.S. PATENT DOCUMENTS 3,744,480 A * 7/1973 Gause ..... A61B 5/1107 482/8
3,759,511 A * 9/1973 Zinkin ..... A63B 21/015 297/423.1
4,824,102 A * 4/1989 Lo ..... A63B 21/157 482/59
4,852,872 A * 8/1989 Lo ..... A63B 21/157 482/59
4,961,569 A 10/1990 Roberge
5,035,417 A * 7/1991 Ross ..... A63B 22/001 482/62
5,149,312 A * 9/1992 Croft ..... A63B 22/001 482/148
5,178,593 A 1/1993 Roberts
5,326,122 A 7/1994 Duffy
5,496,238 A 3/1996 Taylor
5,692,994 A 12/1997 Eschenbach
5,853,184 A 12/1998 Lofgren et al.
5,938,570 A * 8/1999 Maresh ..... A63B 22/001 482/57
6,500,099 B1 * 12/2002 Eschenbach ..... A63B 21/152 482/121
6,547,702 B1 * 4/2003 Heidecke ..... A63B 21/0053 482/57
7,530,932 B2 5/2009 Lofgren et al.
7,993,247 B1 * 8/2011 Eschenbach ..... A63B 22/001 482/51
9,474,925 B1 * 10/2016 Hsiung ..... A63B 21/225
(Continued)

*Primary Examiner* — Andrew S Lo
(74) *Attorney, Agent, or Firm* — Robert C. Montgomery; Montgomery Patent & Design, LP

(57) ABSTRACT

A respiratory training device provides a method for assisting in training for a more effective breathing technique, particularly when performing exercises with the device. The exercise device is constructed similar to an exercise bicycle, and having movable handle grips that motion a rotating wheel. An abdominal pad is located at the rear of the device. The device is supported on a platform and having a bench seat. In use, the user practices a particular breathing technique while pressing their abdominal area against the pad and operating the handle grips.

9 Claims, 4 Drawing Sheets

(56) References Cited

U.S. PATENT DOCUMENTS

| | | | | |
|---|---|---|---|---|
| 2004/0198563 | A1* | 10/2004 | Howell | A63B 22/0012 482/62 |
| 2005/0143226 | A1* | 6/2005 | Heidecke | A63B 21/0053 482/62 |
| 2008/0085819 | A1* | 4/2008 | Yang | A63B 21/015 482/62 |
| 2009/0075786 | A1* | 3/2009 | Merli | A63B 22/001 482/63 |
| 2009/0239714 | A1* | 9/2009 | Sellers | A63B 22/001 482/52 |
| 2011/0028277 | A1* | 2/2011 | Merli | A63B 22/001 482/63 |
| 2012/0000496 | A1* | 1/2012 | Razon | A61H 3/04 135/67 |
| 2012/0238411 | A1 | 9/2012 | McBride et al. | |
| 2015/0065305 | A1* | 3/2015 | Dalton | A63B 21/023 482/52 |
| 2015/0273267 | A1* | 10/2015 | Manzke | A63B 21/012 482/57 |

* cited by examiner

RESPIRATORY TRAINING DEVICE AND METHOD OF USE THEREOF

RELATED APPLICATIONS

The present invention was first described in and claims the benefit of U.S. Provisional Application No. 62/032,868 filed Aug. 4, 2014, the entire disclosures of which are incorporated herein by reference.

FIELD OF THE INVENTION

The present invention relates generally to a training device providing a method for assisting in training for a more effective breathing technique.

BACKGROUND OF THE INVENTION

The lack of proper breathing technique is often the initial cause of many physical illnesses. Without sufficient oxygen, one's organs—including the heart, lungs and brain will quickly weaken. Overtime, this oxygen deprivation ultimately affects the ability to perform daily activities including beneficial exercises which may then lead to other health problems. As such, it is well known that the ability to distribute oxygen to other organs within the body via the bloodstream is critical to not only increasing endurance, but maintaining and enhancing life as well.

Without a proper breathing technique, users will always feel tired and unable to perform basic tasks. Furthermore, the ability to properly breathe aids in retarding the aging process, and revitalizes muscles for a long life. Accordingly, there exists a need for a means by which a user can be easily taught proper breathing techniques, and have such techniques reinforced so that such techniques become rote and easily reproduced in one's daily life. The use of the training device and method of use provides users the benefits of proper and healthy breathing, and helps teach them to breathe properly even when not using the invention.

SUMMARY OF THE INVENTION

The inventor has recognized the aforementioned inherent problems and lack in the art and observed that there is a need for a training device providing a method for assisting in training for a more effective breathing technique.

It is therefore an object of the invention to provide a training device, comprising a support frame which comprises of a foot platform and a seat platform which are vertically upstanding and secured near an end of the foot platform. The device also comprises a training device assembly which has a rotating member, a transmission in mechanical communication with the rotating member via a pair of linkage members and secured within a housing attached to the rotating member, a pair of reciprocating handlebars each in mechanical communication with one (1) of the pair of linkage members, a device frame securing the rotating member and the housing to the foot platform, a processor configured to be in electrical communication with a power source, a display in electrical communication with the power source and located on the frame, a sensing means in mechanical communication with the rotation member and the transmission, and an abdominal pad adjustably attached to an upper end of a post, the post having a lower end attached to the housing.

The device also comprises a resistance mechanism which is attached to each of the pair of handlebars. The foot platform also comprises a plurality of casters along the bottom surface. The support frame is secured to an upper surface of the foot platform using a plurality of fasteners which may be brackets. The seat platform may consist of a bench seat. The abdominal pad is designed with an outer curve which is adapted to align with the curves of a given user's abdomen. The abdominal pad comprises a plate affixed to a rear side of the pad and a fixture affixed to the plate opposite the pad. The fixture is capable of being secured at a given user's desired position along the post. The fixture consists of a hand knob, a threaded shaft mechanically secured to the hand knob and a support frame which has an aperture. The fixture is capable of traveling along the post and secured in place by the threaded shaft. The threaded shaft also has a captive feature which prevents the removal of the threaded shaft from the fixture.

The method for using the device is as follows: step one (1), having a user obtain a device as described above; step two (2), having the user apply a force to the seat platform; step three (3), having the user adjust the abdominal pad to abut the user's abdomen; step four (4), having the user apply a force by pressing his or her abdomen against the abdominal pad; step five (5), having the user apply an alternating force by motioning the pair of reciprocating handlebars back and forth, resulting in the spinning of the rotating member; step six (6), having the user breath during steps one through five (1-5) through his or her nose and exhaling through his or her mouth; step seven (7), having the user continue the motioning, pressing, and breathing steps for a minimum of five minutes; step eight (8), having the user physically engage the display while performing the motioning, pressing, and breathing steps to regulate and monitor the user's performance; step nine (9), having the user adjust the resistance mechanism attached to each of the pair of handlebars to a desired greater or lesser force; step ten (10), having the user adjust the fixture along the length of the post; and lastly step eleven (11), having the user turn the hand knob which cause the threaded shaft to secure the fixture in place along the post.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
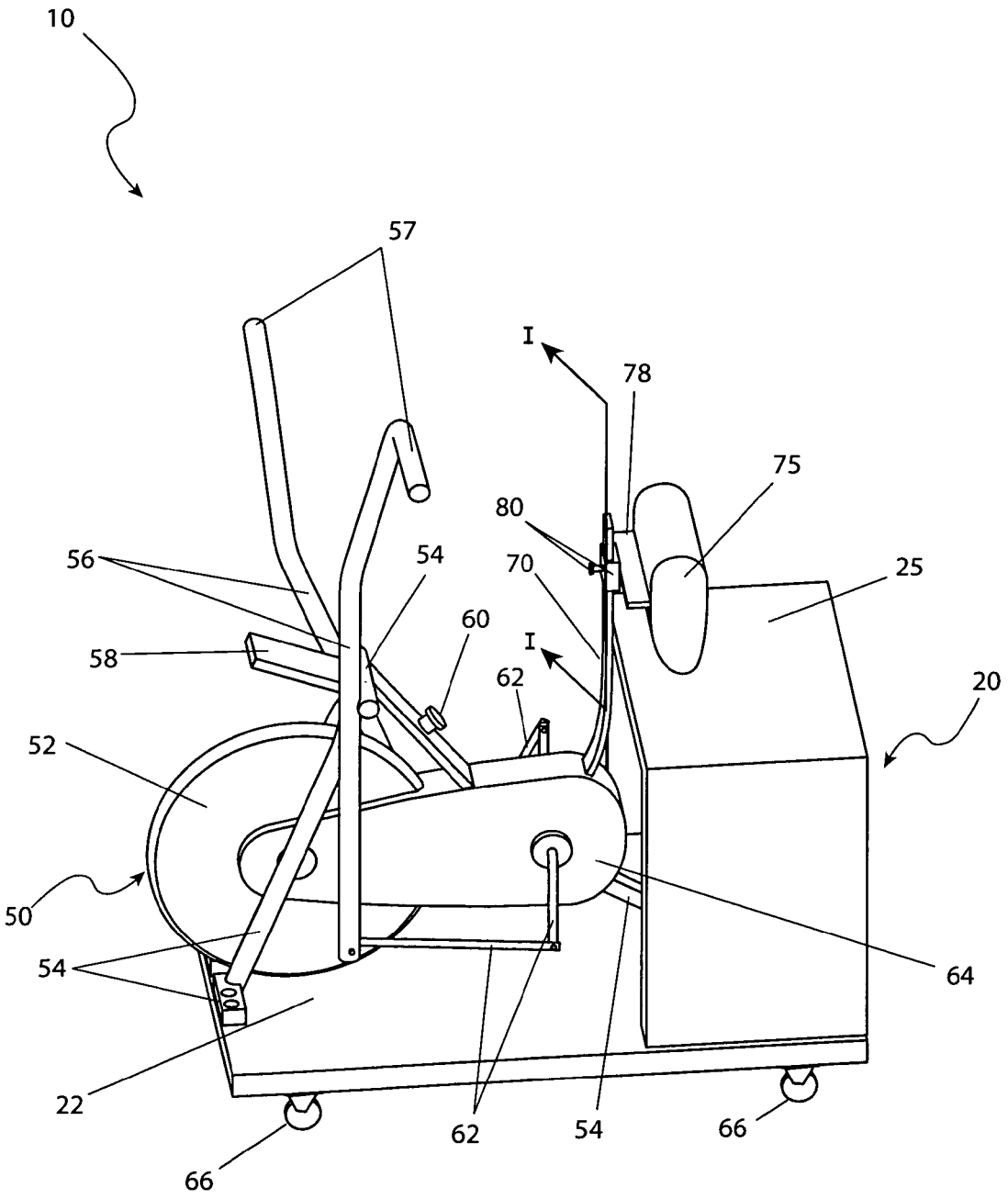
FIG. 1 is a perspective view of a respiratory training device 10, according to a preferred embodiment of the present invention.

10 respiratory training device
20 user support frame
22 foot platform

25 seat platform
50 training device assembly
52 rotating member
54 training device frame
56 reciprocating handlebar
57 hand grip
58 display
60 resistance adjustment mechanism
62 linkage
64 transmission housing
66 caster
70 post
75 abdominal pad
78 plate
80 height adjustment fixture
100 user
105 abdomen
110 outer curved surface
115 hand knob
120 threaded shaft
122 captive feature
125 support frame
130 first applied force
135 second applied force
140 third applied force
145 fourth applied force

DETAILED DESCRIPTION OF THE PREFERRED EMBODIMENT

The best mode for carrying out the invention is presented in terms of its preferred embodiment, herein depicted within FIGS. 1-4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a respiratory training device (herein described as the "apparatus") 10, which provides an exercise machine that provides an effective upper body workout while reinforcing a proper breathing technique.

Referring now to FIG. 1, a perspective view of the apparatus 10, according to the preferred embodiment of the present invention, is disclosed. The apparatus 10 provides a user support frame 20 and a training device assembly 50. The user support frame 20 includes a foot platform 22 and a seat 25. The user support frame 20 provides an "L"-shaped structure onto which a user 100 occupies a rearwardly located seat 25 and places their feet upon a foot platform 22 during performance of an upper body and breathing training workout session. The user support frame 20 is envisioned being made of durable rigid materials such as, but not limited to: metal, wood, or plastic, and may be covered with carpeting, padding, or the like based upon a user's preference. It is envisioned that the foot platform 22 would provide a plurality of casters 66 along a bottom surface to provide convenient portability of the apparatus 10. The foot platform 22 provides a means of attachment of a training device frame portion 54 of the training device assembly 50 using suitable brackets fastener portions. The seat 25 is stylized as a bench-type seating platform in a preferred embodiment.

The training device assembly 50 is envisioned to provide a similar construction as a conventional stationary bicycle exercise machine including a rotating member 52, a pair of reciprocating handlebars 56 with grip portions 57, a resistance adjustment mechanism 60, a processor; and, a digital display 58 in electrical communication with a sensing means in mechanical communication with the rotating member 52. The sensing means communicates physical data gleaned from the rotating member 52 and coupled with the resistance settings of the adjustment mechanism 61 communicates performance parameters to the processor which is in electrical communication with the digital display 58. The training device assembly 50 also includes a plurality of linkage members 62 and a transmission (not shown), housed in a housing 64 which mechanically couple the reciprocating handlebars 56 to the rotating member 52, embodied as a front wheel of a stationary bicycle.

The abdominal pad 75 includes an integral height adjustment fixture 80 along a rear surface which provides height adjustable attachment to a post 70 portion of the training device assembly 50. The post 70 is envisioned to be made of rectangular tubing being insertable through the height adjustment fixture 80, being integral to, and protruding upward from the training device assembly 50 to allow a user 100 to selectively position the abdominal pad 75 against their abdominal muscles 105 (see FIG. 2). The post 70 is supported by the transmission housing 64, as it is located directly below and in front of the seat 25.

Figure 2:
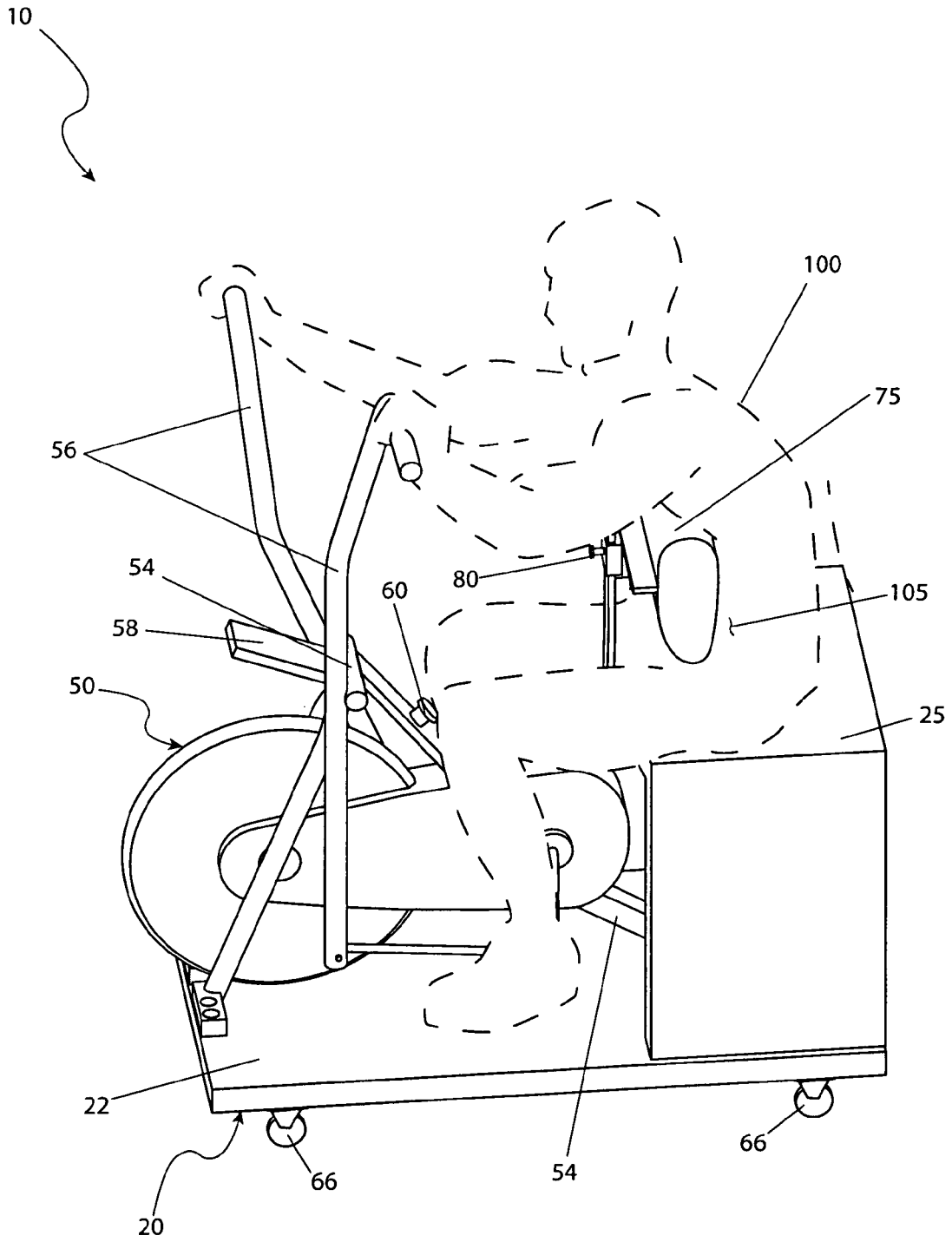
FIG. 2 is an environmental view of the respiratory training device 10 depicting an in-use state, according to a preferred embodiment of the present invention.

Referring now to FIG. 2, an environmental view of the apparatus 10 depicting an in-use state, according to the preferred embodiment of the present invention, is disclosed. In use, a user 100 sits upon the seat 25 with their feet stationarily positioned upon the foot platform 22, while grasping and motioning the reciprocating handlebars 56. The user 100 may adjust a level of resistance to movement of the reciprocating handlebars 56 if desired using a knob portion of the resistance adjustment mechanism 60. Additionally, the user 100 is encouraged to perform a particular breathing technique 100 during the workout to maximize an effectiveness of the workout routine (as described below). It is envisioned that the user 100 will experience a strengthening of heart and lungs, thereby obtaining a higher level of endurance.

Figure 3:
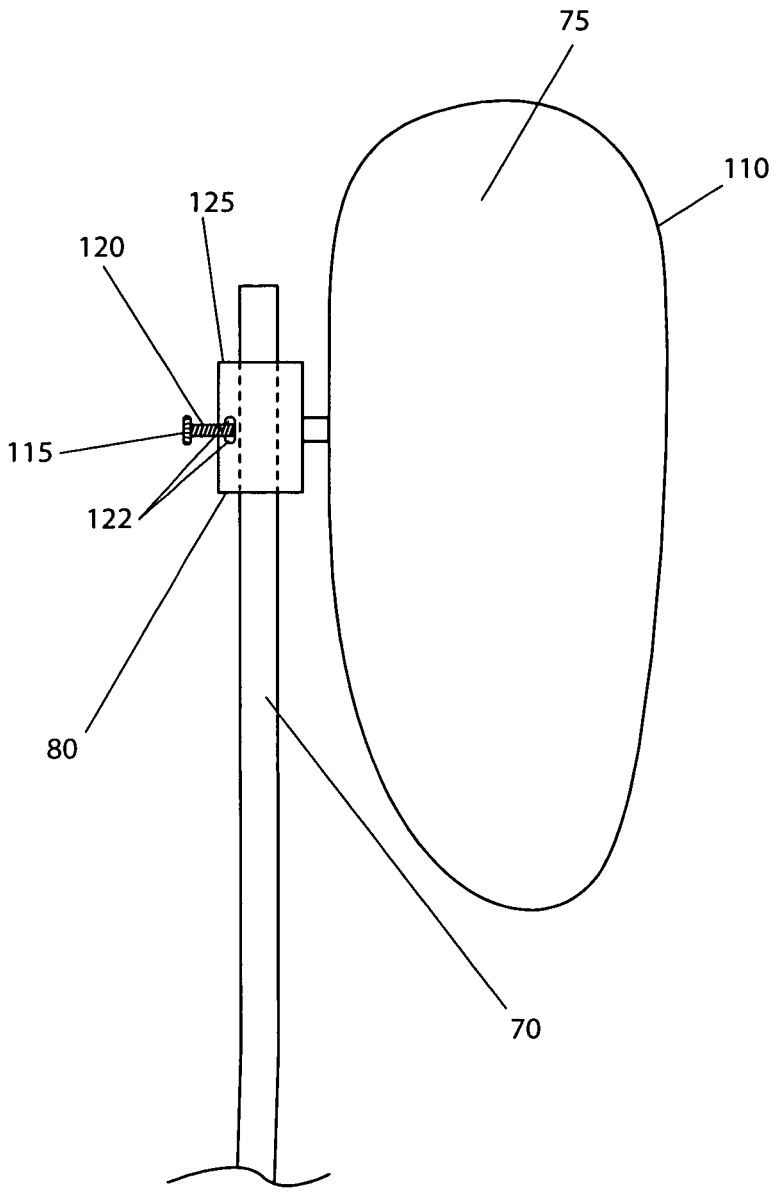
FIG. 3 is a sectional view of the abdominal pad 75 along with its supporting structure as seen along a line I-I as shown in FIG. 1, according to a preferred embodiment of the present invention; and, FIG. 4 is a mechanical force diagram depicting the actions and forces generated by the respiratory training device 10, according to a preferred embodiment of the present invention.

Referring next to FIG. 3, a sectional view of the abdominal pad 75 along with its supporting structure as seen along a line I-I as shown in FIG. 1, according to the preferred embodiment of the present invention is disclosed. The abdominal pad 75 is provided with an outer curved surface 110 that closely aligns with the abdomen 105 (as shown in FIG. 2) of the user 100 (as shown in FIG. 2). Said alignment is critical to the proper use of the respiratory training device 10 along with obtaining the maximum physical benefit. Alignment is obtained by use of the height adjustment fixture 80 which necessitates turning a hand knob 115 that is connected to a threaded shaft 120. A feature 122 located on the distal end of the threaded shaft 120 enables the threaded shaft 120 to be held captive by a support frame 125 that slides along the post 70. Simultaneously, the support frame 125 is mechanically connected to a plate 78 affixed to a rear of the abdominal pad 75. When the proper position of the abdominal pad 75 is obtained by test fitting, trial and error process, the hand knob 115 is tightened down, forcing the threaded shaft 120 against the post 70 where it remains firmly in position until further adjustment, perhaps for a different user 100, is necessary. The hand knob 115 is then loosened to enable further adjustment.

Figure 4:
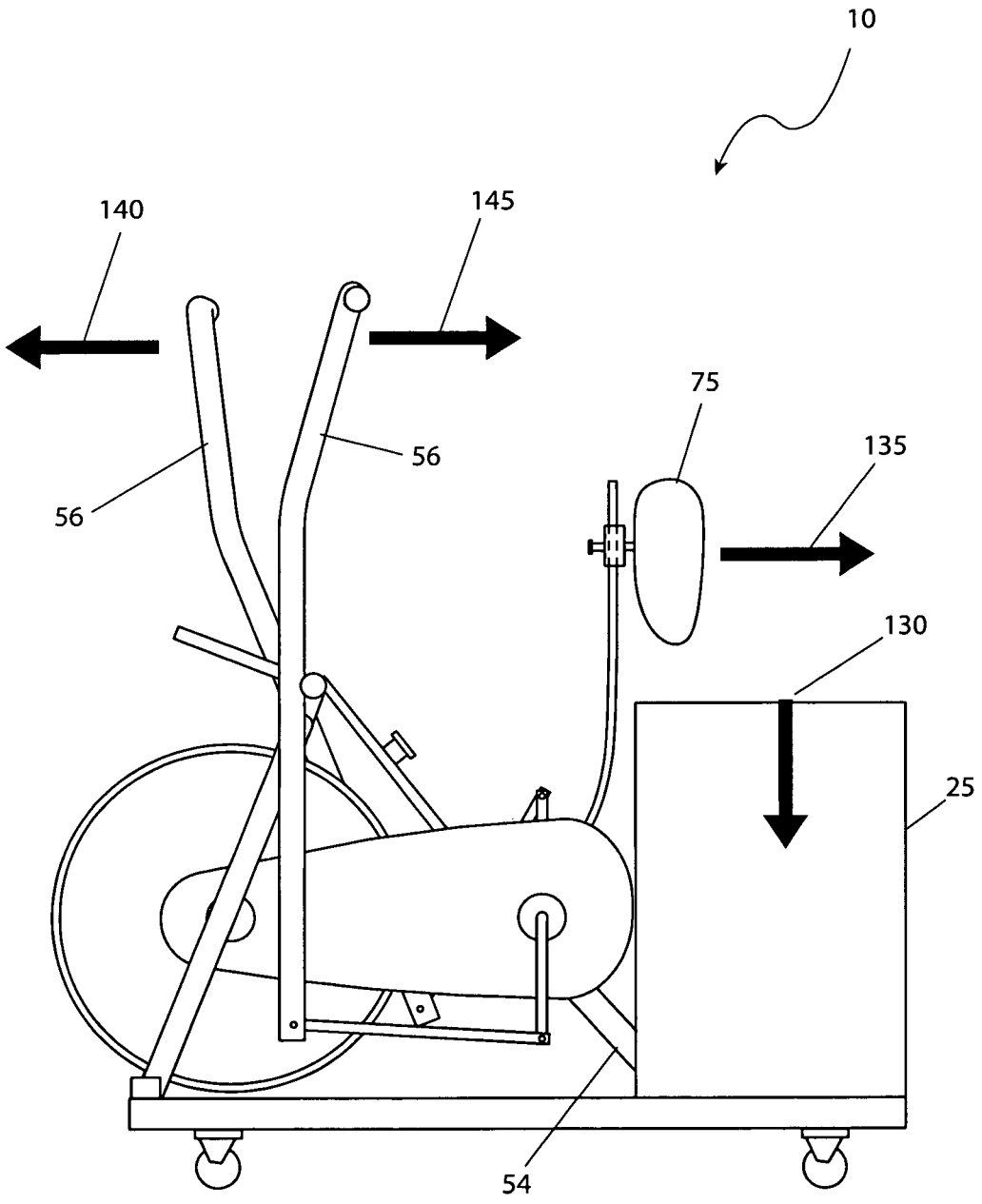

Referring finally to FIG. 4, a mechanical force diagram depicting the actions and forces generated by the respiratory training device 10, according to a preferred embodiment of the present invention is disclosed. A first applied force 130 is generated when the user 100 (as shown in FIG. 2) sits upon the seat 25. A second applied force 135 is generated by the abdominal pad 75 against the abdomen of the user 100 (as shown in FIG. 2). Said second applied force 135 is then magnified to improve the breathing process of the user 100 (as shown in FIG. 2) as the reciprocating handlebar 56 are driven back and forth in accordance with a third applied force 140 and a fourth applied force 145 as shown by the arms of the user 100 (as shown in FIG. 2). It is envisioned the tension and speed of the third applied force 140 and a fourth applied force 145 can be varied in an increasing manner as the user 100 (as shown in FIG. 2) improves with each cyclic use of the respiratory training device 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed and utilized as indicated in FIGS. 1-4.

The method of configuring and utilizing the apparatus 10 may be achieved by performing the following steps: procuring the apparatus 10; sitting upon the seat 25 with feet flat on the foot platform 22; adjusting the height of the abdominal pad 75 against one's abdomen 105 using the height adjustment fixture 80; grasping grip portions 57 and motioning the reciprocating handlebars 56 forward and rearward in a reciprocating manner; pressing an abdominal area 105 against the abdominal pad 75 during the exercise; performing an enhanced breathing technique during the exercise by breathing in through the nose and exhaling through the mouth to increase oxygen intake into the body and muscles; continuing the exercise for approximately five minutes (5 mires) duration; utilizing the display 58 while exercising to regulate and monitor exercise parameters such as, but not limited to handlebar reciprocating frequency, heart rate, and duration; repeating the workout routine daily; strengthening heart and lung muscles by consistently performing the exercise over a period of time while practicing the breathing technique; and, benefiting from strengthened heart and lung muscles and a higher level of endurance, afforded a user 100 of the present invention 10.

It is envisioned that performing the exercise as described above in a consistent manner over a period of approximately thirty-five to forty-five days (35-45 d) will enable the user's body to experience a strengthening of heart and lung muscles, thereby obtaining a higher level of endurance.

The present invention 10 improves the physical body condition of the user 100 and provides a lifelong benefit through continued reinforcing use. Said present invention 10 improves the blood oxygen level of the user 100 thus aiding in the retardation of the aging process, the rejuvenation of tissues and results in stronger lungs that will expel a higher percentage of carbon dioxide from the tissues. Usage per the described description will result in proper breathing and an improved quality of life. This is accomplished by "retraining" the lungs to a natural breathing process to obtain the maximum performance from the human body by burning food energy and not lactic acid. The actual retraining process is enhanced by pressure caused by the abdominal pad 75 pressing against the abdominal muscles thus forcing the proper breathing method by breathing in (inhaling) through the nose and breathing out (exhaling) through the mouth.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A training device, comprising:
- a support frame comprising:
  - a foot platform; and,
  - a seat platform, vertically upstanding and secured near an end of said foot platform;
- a training device assembly, comprising:
  - a rotating member;
  - a transmission in mechanical communication with said rotating member via a pair of linkage members and secured within a housing attached to said rotating member;
  - a pair of reciprocating handlebars each in mechanical communication with one of said pair of linkage members;
  - a device frame securing said rotating member and said housing to said foot platform;
  - a processor configured to be in electrical communication with a power source;
  - a display in electrical communication with said power source and located on said frame;
  - a sensing means in mechanical communication with said rotation member and said transmission; and,
  - an abdominal pad secured between said seat platform and said pair of reciprocating handlebars being adjustably attached to an upper end of a post, said post having a lower end attached to said housing;
  - wherein said abdominal pad is configured with an outer curve adapted to align with a given user's abdomen.

2. The device of claim 1, further comprising a resistance mechanism attached to each of said pair of handlebars.

3. The device of claim 1, wherein said foot platform further comprises a plurality of casters along a bottom surface thereof.

4. The device of claim 1, wherein said support frame is secured to an upper surface of said foot platform via a plurality of fasteners.

5. The device of claim 4, wherein said plurality of fasteners comprises brackets.

6. The device of claim 1, wherein said seat platform is a bench seating platform.

7. The device of claim 1, wherein said abdominal pad further comprises:
- a plate affixed to a rear side thereof; and,
- a fixture affixed to said plate opposite said abdominal pad;
- wherein said fixture is capable of being secured at a desired position along said post.

8. The device of claim 7, wherein said fixture further comprises:

a hand knob;

a threaded shaft mechanically secured to said hand knob; and, a support frame comprising an aperture;

wherein said fixture travels along said post; and, wherein said threaded shaft secures said fixture to said post.

9. The device of claim 8, wherein said threaded shaft further comprises a captive feature located on a distal end of said threaded shaft;

wherein said captive feature prevents the removal of said threaded shaft from said fixture.

* * * * *